United States Patent [19]

Gordon

[11] Patent Number: 4,558,785

[45] Date of Patent: Dec. 17, 1985

[54] TEAR TAPE OPENABLE CONTAINER

[75] Inventor: Robert L. Gordon, Monroe, N.Y.

[73] Assignee: International Paper Company, New York, N.Y.

[21] Appl. No.: 659,110

[22] Filed: Oct. 9, 1984

[51] Int. Cl.[4] ..... B65D 75/66

[52] U.S. Cl. ..... 206/617; 206/627

[58] Field of Search ..... 206/617, 618, 606, 627, 206/264

[56] References Cited

U.S. PATENT DOCUMENTS

| | | | |
|---|---|---|---|
| 1,570,682 | 1/1926 | Kling | 206/617 |
| 1,789,699 | 1/1931 | Durham | 229/87 |
| 2,053,116 | 9/1936 | Sperry | 206/627 |
| 2,147,411 | 2/1939 | McCracken | 206/264 |
| 2,197,219 | 4/1940 | Groshong | 99/189 |
| 2,296,830 | 9/1942 | Beals | 206/264 |
| 2,296,951 | 9/1942 | Rosen et al. | 229/87 |
| 2,583,669 | 1/1952 | Santina | 206/617 |
| 2,790,594 | 4/1957 | Hultkrans et al. | 229/87 |
| 2,870,953 | 1/1959 | Parker et al. | 229/51 |
| 2,909,312 | 10/1959 | Conerty | 206/606 |
| 2,935,187 | 5/1960 | Seidler | 206/264 |
| 2,985,287 | 5/1961 | Schulz | 206/46 |
| 3,048,325 | 8/1962 | O'Brien | 206/618 |
| 3,141,602 | 7/1964 | Anderson | 229/87 |
| 3,203,618 | 8/1965 | Andrews et al. | 229/40 |
| 3,276,665 | 10/1966 | Rasmussen | 206/606 |
| 3,276,666 | 10/1966 | Johnson | 229/51 |
| 3,291,372 | 12/1966 | Saidel | 229/51 |
| 3,314,587 | 4/1967 | Johnson | 206/606 |
| 3,519,125 | 7/1970 | Macneale | 206/65 |
| 3,531,045 | 9/1970 | Johnson | 229/51 |
| 3,552,636 | 1/1971 | Geary | 229/51 |
| 3,554,437 | 1/1971 | Kimsey | 229/66 |
| 3,823,866 | 7/1974 | Elward et al. | 229/51 |
| 4,091,929 | 5/1978 | Krane | 206/602 |
| 4,141,487 | 2/1979 | Faust et al. | 229/43 |

*Primary Examiner*—Stephen P. Garbe

*Attorney, Agent, or Firm*—Richard J. Ancel

[57] ABSTRACT

A severable wall construction for a tray forming package or carton. One or more circumferential zones is each defined by overlapping wall portions of the package or carton, each zone being Z-shaped in transverse cross-section. A tear strip (filament tape) is positioned along each zone, between the middle and one leg of the Z. The tear strip is pulled to sever the Z at the junction of the middle and one leg and thereby separate the package or carton into two portions. The remaining middle and other leg of the Z forms an edge hem for one of the two separated package or container portions. The hem edge is thus defined by a smooth rim. In one application of the invention, a paper towel roll package is provided with two Z-shaped zones around its circumference. After ripping both Z zones, that portion of the package originally between them is discarded, and two trays for display the paper towel rolls are defined. Kraft paper or paperboard forms the package or container. The invention may also be applied to multiple package carriers, i.e., carriers for cans, for easy container opening and access. The invention also may be applied to a folding carton of rectangular form or a round paperboard can, with the Z fold and tear strip providing a reclosable lid.

6 Claims, 6 Drawing Figures

TEAR TAPE OPENABLE CONTAINER

This invention relates to a wall construction for a container and more particularly to a wall construction which permits the container to be severed into two or more sections or portions. The wall construction includes a tear strip suitably embedded in the sheet material which forms the walls of the container or package, the tear strip being utilized to rip a specified part of the wall material to thereby effect severance of the container into two or more portions. The container may be regarded as defined by an upper portion and a lower portion, the upper portion having a lower edge and the lower container portion having an upper edge, these portions being normally integrally joined.

One container construction in which the subject invention exhibits particular utility relates to a package or bundle of paper towels. Conventionally, several rolls of paper towels are packaged in corrugated containers or are wrapped by paper or the like, with the individual axes of the paper towels being parallel, the rolls being vertically disposed for shipping purposes. This container is then shipped to a place of sale, such as a supermarket or other retail establishment. There, the container is often formed into two sections by simply cutting with a razor blade or knife circumferentially around the container to thereby form two trays, with each tray being set on its bottom and stacked and with the purchaser being able to select any one of the paper rolls from the stacked trays. A disadvantage of this construction is that in severing the walls of the package or container to form the two trays, the paper rolls or other product become themselves cut, with resultant damage and loss of merchantability of that particular or those particular products which have been cut.

The prior art is aware of package constructions employing tear strips to separate a single package into two or more portions, the tear strips being attached to or embodied in the walls of the package or container. Such a wall construction is sometimes referred to as a rip construction. For example, U.S. Pat. No. 3,276,666 issued to Johnson shows such a construction. Similar constructions are illustrated by U.S. Pat. No. 3,823,866 issued to Elward et all and U.S. Pat. No. 3,291,372 issued to Saidel. However, even the substitution of a rip cord or tear strip construction in lieu of the knife opening method suffers certain drawbacks. For example, as illustrated in noted Saidel patent, the use of tear strips often results in an uneven edge of open ends of the resulting tray sections formed by the ripping or tearing of the tear strip.

Further, the use of a tear strip can result in an uneven edge adjacent to area of tear, such an uneven edge sometimes marring any graphics or indicia, such as brand names, color displays and the like and also weakens the tray walls.

According to the practice of this invention, the noted drawbacks attendant typical prior art constructions are substantially overcome by associating the tear strip or ripping cord within a Z-shaped overlap, to form a border zone, the overlap extending substantially around the circumference of the container or package which is to be separated. One end of the tear strip is provided with a tab externally accessible of the package or container for manual grasping. The tear strip is positioned between the outer leg of the Z border zone or ripping zone, and the middle leg of the Z. In use, the tear strip is pulled towards the junction of the outer and middle legs of the Z, to thereby effect severance between them. The pulling is carried out continuously around the circumference, until the package or carton is completely severed to thereby define two portions. Preferably, the middle leg of the Z is provided with adhesive at the place of manufacture of the blank or web sheet material from which the package or container is formed. The result is that one of the two separated sections exhibits a hem, with the upper rim of one container section defined by an overlap. The rim is smooth, and provides tray strength in distinction to certain prior art constructions employing ripping cords or tear strips, such as that of the noted Saidel patent.

The prior art is aware in general, of Z-shaped folds, such as U.S. Pat. No. 3,203,618 issued to Andrews et al, U.S. Pat. No. 2,296,951 issued to Rosen et al and U.S. Pat. No. 2,053,116 issued to Sperry. However, these particular prior art Z folds are not used in connection with a tear strip or ripping cord.

While exhibiting particular utility in the packaging of paper towels or other rod-like articles subject to damage upon opening of the container or package, the invention also exhibits utility in any type of package or container, fashioned from a flexible sheet material such as paper or paperboard, wherein it is desired to remove one portion of the container, such as a lid closure portion, so that the remaining container portion exhibits a smooth upper rim.

IN THE DRAWINGS

FIG. 1 is a plan view showing a blank fashioned of paper and embodying the Z tear wall or tear strip this invention, the blank having crease lines to facilitate its folding about a plurality of objects, such as rolls of paper towels, to thereby form a package.

FIGS. 1-A and 1-B show certain details of FIG. 1 in enlargement.

Figure 1:
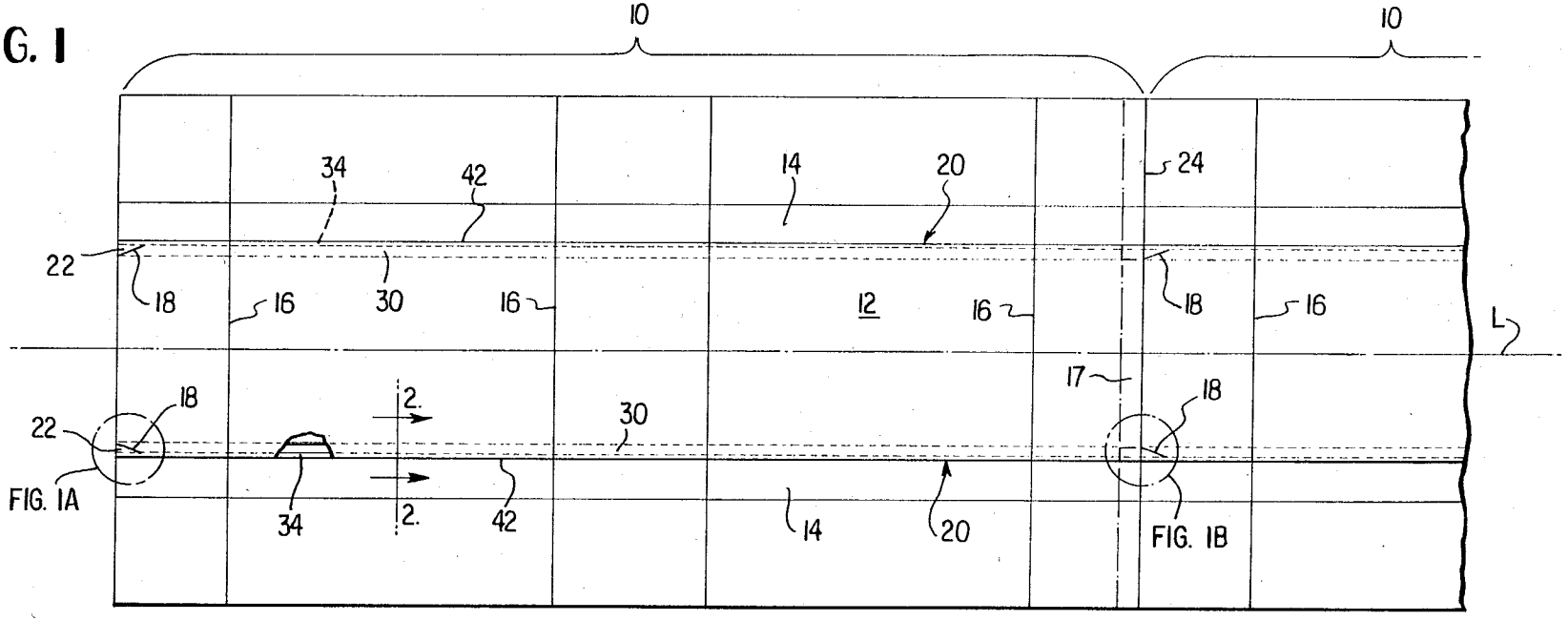

Referring now to FIG. 1 of the drawings, the numeral 10 denotes generally a blank fashioned from paper, such as Kraft paper, and is of generally rectangular form having a longitudinal axis L. In practice each blank 10 is defined by transversely cutting a continuous web, the cut extending from the upper to the lower web edge, as indicated by the numeral 24. The numeral 12 denotes the main or central portion of the blank with the numerals 14 denoting the upper and lower portions thereof. The numeral 16 denotes any one of a plurality of crease lines to facilitate folding of the paper blank about products to be packaged, such as a plurality of wrapped paper towel rolls, each being generally cylindrical. The numeral 18 denotes either of two cut lines extending from the left edge of the blank and extending towards an upper or a lower edge, respectively, of the blank. The numeral 20 denotes any one of two border zones or ripping zones each defined by Z folds now to be described.

Figure 2:
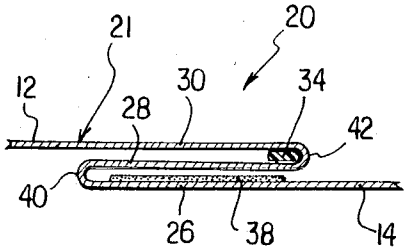
FIG. 2 is a view taken along section 2—2 of FIG. 1.
Figure 1B:
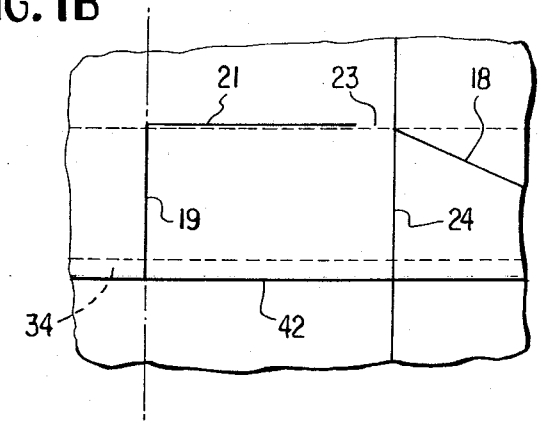
Figure 1A:
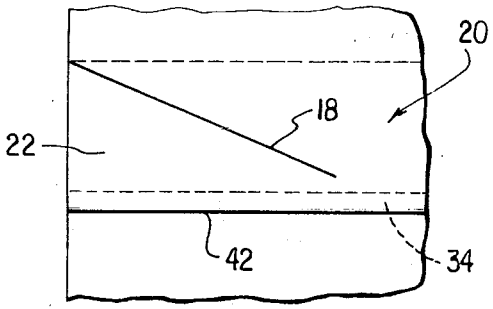

Referring now to FIG. 2 of the drawings, one of the two Z folds is shown in detail. Commencing with a longitudinally extending portion 14, Z fold 20 is defined by a first outer leg 26, a middle leg 28 and a second outer leg 30. The numeral 34 denotes a continuous tear strip or filament tape fashioned, for example, of a plactics material such as nylon or polypropylene. Preferably the tear tape 34 is rectangular in cross-section, and is provided with a pressure sensitive adhesive on one major face, to thereby adhere it to leg 30. The numeral 38 denotes an adhesive which secures middle leg 28 to outer leg 26. The numeral 40 denotes the bight portion between outer leg 26 and middle leg 28 while numeral 42 denotes the bight between middle leg 28 and the other outer leg of the Z fold 20.

As shown at FIG. 1-A, a cut 18 extends from the left end of each Z fold on each blank 10, through legs 26, 28 & 30, towards but short of the filament tape 34. This defines a manually graspable tab 22 for pulling tape 34. FIG. 1-B illustrates a vertical cut 19, entirely through the Z fold and tape 34, and extending from bight 42 to a short distance beyond bight 40, where it meets with one end of longitudinal cut line 21. Cut 21 extends substantially across the width of manufacturer's flap or zone 17 (on the right edge of blank 10), terminating a short distance 23 from the right edge of blank 10. As shown at FIG. 1-B, the location of cut 21 is at the junction of sheet or blank portion 12 and outer Z leg 30.

Cuts 18, 19, 21 and 24 are made by a single cutting knife, not illustrated, the knife being so configured that these cuts are all made simultaneously or nearly so. This cutting may be readily visualized by reference to the right portion of the whole blank 10 of FIG. 1. Namely, the knife cuts the continuous web to define the trailing edge of one blank 10 (cuts 19, 21 and 24) and at the same time effects cuts 18 on the left edge of the next blank 10, assuming a web motion in FIG. 1 from right to left.

Cuts 19 and 21 are made on the manufacturer's flap 17 of the blank in order that the severing of the bight portion 42 by the filament tape 34 will not mar or disfigure the hem when the tape is pulled through the manufacturer's flap 17 on the two trays formed when central portion 12 is removed. Cuts 19 and 21 provided a clean separation of center panel 12 from the tray portions because of the multiple thicknesses which the manufacturer's overlap join provides.

In one method of packaging, rolls of Kraft paper for wrapping towel rolls are provided to form a package, the package providing the Z folds and tape, then the blanks 10 are formed and wrapped around the product.

Figure 3:
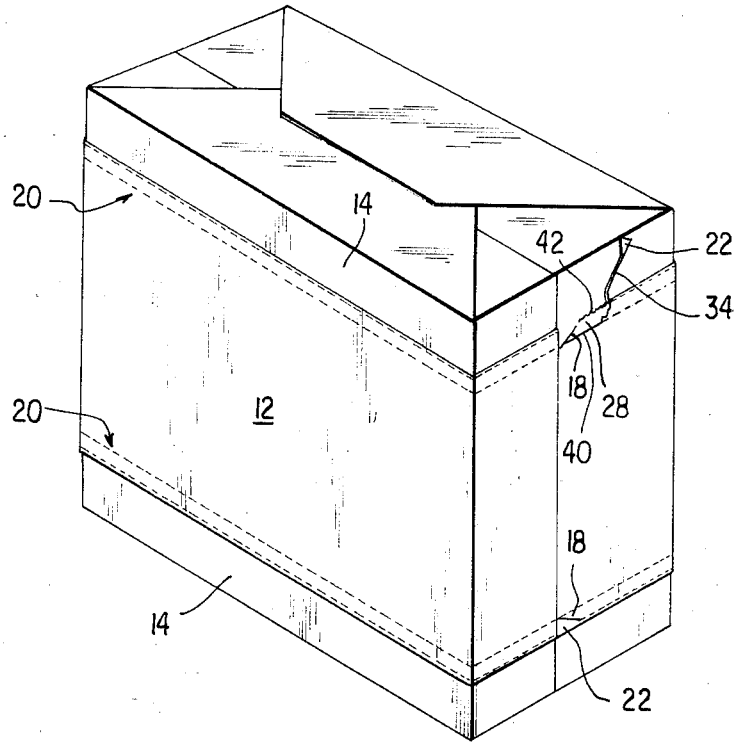
FIG. 3 is a perspective view of a package formed from the blank of FIG. 1 and illustrates an initial step in opening the package.
Figure 4:
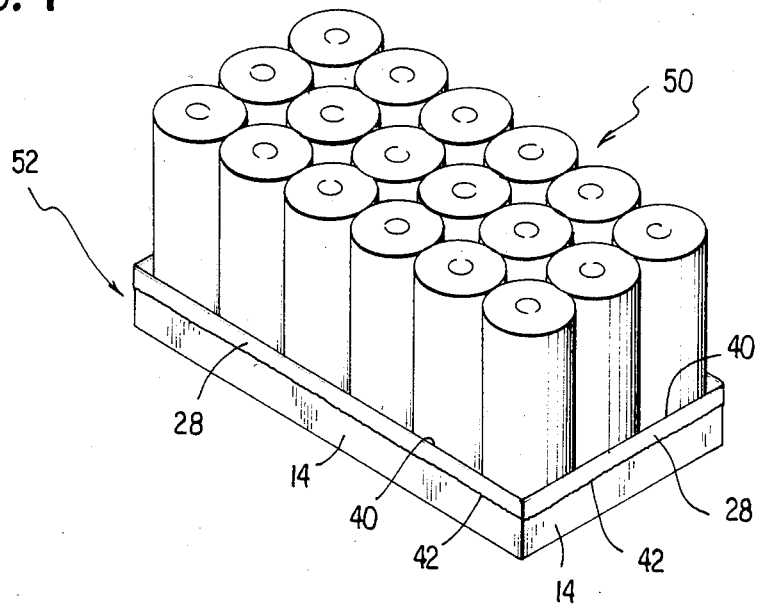
FIG. 4 illustrates the lower portion of the package of FIG. 3, after the central circumferential zone of the paper has been removed.

Referring now to FIGS. 3 and 4 of the drawings, the blank 10 has been folded and glued about a plurality of wound paper towel rolls, denoted generally by the numeral 50 at FIG. 4, so as to define the package shown at FIG. 3. When it is now desired to separate the package of FIG. 3 into two portions, the circumferential center portion, denoted by the numeral 12, is removed by ripping or tearing each of the Z folds. Either tray is denoted by the numeral 52, as shown at FIG. 4. To effect this separation, the user manually grasps the tabs 22, in sequence, and pulls each tab, to thereby pull the tear strip 34. It is preferable to pull each tape 34 through fold 42 which acts as a guide to prevent promulgation of the tear. Thus, tape 34 is pulled in the direction towards the tray bottom which is to be formed. Thus, at FIG. 3, upper tab 22 is to be pulled upwardly as it is being pulled around the circumference of the package. Lower tab 22, as shown at FIG. 3, is pulled with the direction of pulling being towards the bottom of the package of FIG. 3, as the pulling continues around the circumference of the container. This will separate the middle portion 12 from the upper and lower portions, with the result being shown as FIG. 4. The reader will observe that the upper rim 40 of tray 52 is smooth, this being the bight portion 40 previously described at FIG. 2. The middle leg 28, adhesively secured to outer leg 26, is on the outside of the tray. The portion of the blank 12 containing the other outer leg of the Z (see FIG. 2) has been discarded along with the remainder of portion 12 which has been removed. The upper rim portion of either tray 52 may be regarded as having a hem defined by the overlapped and adhered together legs 26 and 28 of its Z fold.

Figure 5:
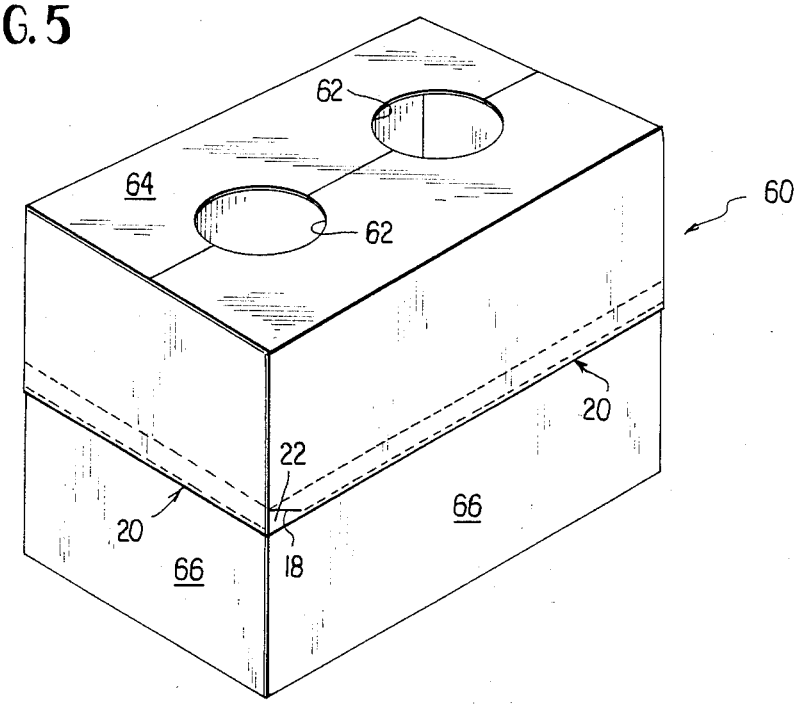
FIG. 5 is a perspective view of a multiple package carrier embodying the Z fold tear construction of this invention.

Referring now to FIG. 5 of the drawings the numeral 60 denotes a multiple package carrier having a lid or upper portion and a lower portion 66. These two portions are joined by Z fold 20, the construction of the Z fold being the same as that previously described and shown in transverse cross-section at FIG. 2. A pair of finger holes 18 is provided for easy lifting. Container 60 is particularly adapted to hold a plurality of cans and may be formed of paperboard by suitably folding a precut and prescored blank which has been provided with a Z fold 20. Upon grasping tab 22 and pulling tape 34 downwardly and around container 60, lid portion 64 is separated from lower portion 66 to obtain access to the cans or other contents. FIG. 5 shows carrier 60 as empty, for purpose of clarity of the construction, although in use it would be filled with cans for example.

Figure 6:
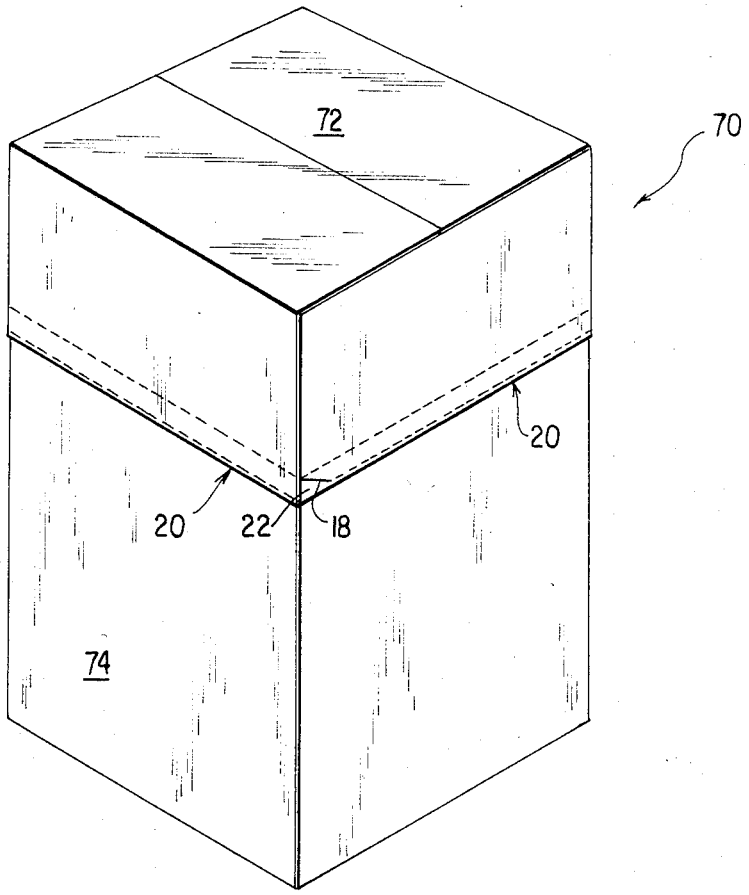
FIG. 6 is a perspective view of a folding carton provided with the Z fold construction of this invention to provide a reclosable lid.

In FIG. 6, a folding carton 70 is shown, also formed for example of a precut and prescored blank, similar to blank 10 previously described. Upper portion 72 will function as a reclosable lid for lower portion 74 upon actuation or activation of Z fold 20 by grasping tab 22 and pulling tape 34 (see FIG. 2) down and around the container to separate the lid. This construction is particularly useful for cereal packaging, i.e., where the carton contents must be protected from outside contaminants and where tapering, prior to ultimate and intended use, will be readily evident.

I claim:

1. A severable wall construction for a closed container having walls, the walls formed of a sheet of foldable, tearable material, such as paper or paperboard, the container having an upper and a lower portion normally integrally joined, the upper container portion having a lower edge and the lower container portion having an upper edge, a border zone circumferentially around the container and forming a boundary between upper and lower container portions, the border zone defined by a partial overlapping between the lower edge of the upper container portion and the upper edge of the lower container portion, the sheet material at the border zone being Z-shaped in a cross-section taken at right angles to the border zone, the Z having an outer leg defined by one of the partially overlapped edges, and having an inner leg defined by the other of the partially overlapped edges, the inner leg being substantially parallel to the outer leg, a filament tear tape positioned between and sandwiched by one of the outer legs and the middle leg of the Z and co-extensive along the border zone, means externally of the container for manually grasping an end of the tear tape, whereby when that filament tape end is grasped and pulled, along the length of the border zone, the junction between the tear tape sandwiching one outer leg and the middle leg of the Z is severed and thereby separates the upper from the lower container portion, and whereby the middle and the other, non-severed outer leg of the Z forms a hem of two layers of the sheet material around one edge of one of the separated container portions, the middle leg of the Z forming the outer layer of the hem, whereby the junction of the middle and non-severed outer legs of the Z forms the upper rim of said one of the separated lower container portions, the middle and that leg of the Z which does not sandwich the tear tape being adhered together in intersurface contact, whereby the middle leg of the Z after separation of the upper and lower container portions remains in intersurface engagement with that leg of the Z to thereby form the hem.

2. The severable wall construction of claim 1 wherein the tear tape is of a lesser width than the cross-sectional length of the middle leg of the Z and is positioned nearer the junction of the tear tape sandwiching leg and the middle leg of the Z than to the junction of the middle and other leg of the Z.

3. A severable container forming blank of a single sheet of foldable and tearable material and a filament tear tape, the blank having at least two parallel rectangular panels each having a longitudinal axis, the longitudinal axes being generally parallel, the at least two panels being joined along a respective longitudinal edge of each, the two common longitudinal edges respectively partially overlapped to define a border zone, the border zone in transverse cross-section thereof being Z-shaped with the two partially overlapped panel edges forming the two outer legs of the Z and a portion of the sheet integrally joining the legs of the Z forming the middle of the Z, the filament tape running along the border zone for substantially the zone length, the filament tape positioned between and sandwiched by one outer leg of the Z and the middle leg, the outer and middle legs of the Z being substantially parallel, whereby when the blank is wrapped around one or more articles to be packaged and then sealed, pulling of one end of the filament tape along the border zone, and toward the junction of the middle leg and said one outer leg of the Z, between which the filament tape is positioned, will cause the junction of the middle and that Z leg to sever, that outer leg of the Z not contacting the filament tape being adhered to the middle leg of the Z, the outer and middle legs of the Z being parallel, whereby a hem of two layers is formed, the hem layers being the middle leg and that outer leg of the Z not originally in contact with the filament tape.

4. The severable container blank and filament tape of claim 3 wherein, at one end of the blank, the legs of the Z are angularly cut from a corner of the border zone at said one edge of the blank, the cut extending toward but short of the filament tape, the cut portion of the Z legs defining means to manually grasp and pull that end of the filament tape adjacent said cut portion.

5. The severable container blank and filament tape of claim 3 wherein one end of the blank is provided with a manufacturer's flap running transversely of said longitudinal axis, and wherein the Z fold and filament tape are cut transversely of the border zone across the entire width of the border zone, at a location where the border zone intersects the manufacturers's flap, and wherein the junction of the sheet and that outer leg of the Z which contacts the filament tape is longitudinally cut, substantially but not completely, across the width of the manufacturer's flap.

6. The severable blank and filament tape of claim 5 wherein the legs of the Z are angularly cut from a point of the junction of the manufacturer's flap and the blank, where the junction intersects the axis of said sheet cut which is in a direction parallel to the border zone, the angular cut extending toward but short of the filament tape.

* * * * *